US006111553A

United States Patent [19]

Steenbuck

[11] Patent Number: 6,111,553

[45] **Date of Patent: *Aug. 29, 2000**

[54] ADJUSTABLE ANTENNA BRACKET

[76] Inventor: Wendel F. Steenbuck, 224 N. Titmus Dr., Mastic, N.Y. 11950

[ * ] Notice: This patent issued on a continued prosecution application filed under 37 CFR 1.53(d), and is subject to the twenty year patent term provisions of 35 U.S.C. 154(a)(2).

[21] Appl. No.: 08/946,142

[22] Filed: Oct. 7, 1997

[51] Int. Cl.[7] ..... H01Q 1/12

[52] U.S. Cl. ..... 343/891; 343/892

[58] Field of Search ..... 343/891, 878, 343/885, 890, 892

[56] References Cited

U.S. PATENT DOCUMENTS

| | | | |
|---|---|---|---|
| 1,644,266 | 10/1927 | Orne | 343/890 |
| 2,510,287 | 6/1950 | Lane et al. | 250/33 |
| 5,467,955 | 11/1995 | Beyersmith | 248/219.3 |
| 5,621,421 | 4/1997 | Kolz et al. | 343/892 |

*Primary Examiner*—Don Wong
*Assistant Examiner*—James Clinger
*Attorney, Agent, or Firm*—Galgano & Burke

[57] ABSTRACT

An adjustable antenna bracket attachable to a pole such as a wooden utility pole or electric transmission tower for simultaneously mounting a plurality of antennas. The adjustable antenna bracket comprises a plurality of horizontally disposed, spaced-apart, rings for straddling a pole about a portion of the vertical outer surface of the pole, and a plurality of parallel vertically disposed pipes attached to the rings and angularly spaced-apart from each other for supporting a plurality of antennas. A plurality of threaded bolts extend radially through threaded bores in at least two of the rings to allow adjustably mounting the antenna bracket to a pole at a predetermined orientation and perpendicular to the earth, i.e., plumb. Also disclosed is an adjustable antenna bracket kit, method of adjustably mounting a plurality of antennas to a pole, and an adjustable antenna bracket for simultaneously mounting a plurality of antennas from a roof top.

25 Claims, 4 Drawing Sheets

ADJUSTABLE ANTENNA BRACKET

BACKGROUND OF THE INVENTION

The present invention relates generally to an adjustable antenna bracket. More particularly, the present invention relates to an adjustable antenna bracket readily attachable to a pole such as a wooden utility pole or electric transmission tower, or to a building roof top, for simultaneously adjustably mounting a plurality of antennas relative to each other, relative to other antenna sites, and plumb with the earth.

All wireless communication systems, regardless of their operating frequencies, utilize antennas of one fashion or another. An antenna transforms AC voltage and current (RF Power) at a given frequency into electromagnetic energy which is then radiated into the atmosphere. The transmitted electromagnetic energy can be shaped and styled depending on the design of the antenna. For example, the total energy can be directed to one or more points or be evenly distributed, e.g., omnidirectional. Moreover, the effective power of the transmission can be doubled, quadrupled or more, depending on antenna design.

It is understood in the wireless communication industry that any wireless system, regardless of the cost expended in the design and fabrication of the associated electronic equipment, will only perform as well as the antenna or antennas to which the system is connected to. Also important is the frequency at which the system operates. Low frequencies and high frequencies will behave differently from each other in the atmosphere. Some frequencies travel through the atmosphere close to the earth's surface following the curvature of the earth over the horizon. Other frequencies travel upward and reflect back to earth off the different layers of the atmosphere, e.g., the troposphere, the ionosphere, the stratosphere. Other frequencies travel in a straight line, i.e., along a "line of sight," and do not bend or reflect. Still other frequencies can penetrate buildings as if they weren't there, while other frequencies will bounce off the surface of buildings and trees or heavily wooded areas.

The personal communication systems (PCS) being introduced to the world are fully digital high frequency systems. In order to handle the high speed data which will be processed, some systems operate at a frequency of about 2 GHz. At this frequency, transmission is along a "line of sight." The antennas required for this type of system must be oriented so that the energy is directed across the surface of the earth, i.e., directed generally tangent to the earth from the antenna site. Antenna sites desiring an omnidirectional pattern for this system typically require the installation of three antennas phased 120 degrees apart from each other and absolutely plumb, e.g., perpendicular to the surface of the earth.

In order to cover a specific geographic region, a large number of antenna sites are necessary. The locations of possible sites include attaching the antennas to existing electric transmission towers which are fixed, machined, steel structures. However, electric utilities are generally reluctant to use electric transmission towers for antenna sites due to safety concerns requiring the power through the electric lines to be turned "off" because of extreme high voltage during installation which normally takes more than sixteen hours depending on available manpower and equipment. In some cases, turning off the power and redirecting the power, i.e., providing a "clearance" can cost thousands of dollars per hour.

Other possible antenna sites include installation of the antennas on wooden utility poles. Installation of antennas to a wooden utility pole typically does not require turning off the power through the electric lines because they may not be present or the voltages are low enough that a clearance is not necessary. However, various problems exist in installing the antennas to wooden utility poles particularly since no two poles are exactly alike. For example, wooden utility poles are typically not installed absolutely perpendicular to the earth, they typically have a taper from the bottom of the pole to the top, and they typically are not straight, i.e., have a curve or bend along their length.

Prior art antenna brackets in use today do not satisfy the demands required for wireless communication systems for easily mounting a plurality of antennas to electric transmission towers or on top of wooden utility poles. In particular, prior art fixed antenna brackets attach to a single antenna thereby requiring three separate fixed brackets and separate installation procedures. Because of the imperfections of wooden utility poles, attaching antennas to a pole via fixed brackets may result in one antenna pointed toward the sky while another is pointed toward the earth. Properly aligning the three antennas requires a high degree of skill by the installer and a great deal of time because of the modifications required to the fixed brackets to overcome the imperfections of the wooden utility pole.

There is, therefore, a need for an adjustable antenna bracket for use in the expanding field of wireless communication which overcomes the above-mentioned drawbacks so that an antenna site having a plurality of antennas can be readily installed with the antennas simultaneously adjusted relative to each other, relative to other antenna sites, and plumb with the earth.

SUMMARY OF THE INVENTION

Accordingly, it is an object of one embodiment of the present invention to provide an adjustable antenna bracket for installing a plurality of antennas in which the bracket is sized to fit over the top of and readily attach to a wooden utility pole while overcoming the imperfections in the size and shape of the wooden utility pole, eliminating human error in separately installing a plurality of fixed brackets and antennas, and reducing the time, labor, and materials (e.g., bolts, shims, etc.) required for positioning the plurality of antennas relative to each other, positioning the plurality of antennas relative to other antenna sites, and aligning the plurality of antennas plumb to the earth.

It is an object of another embodiment of the present invention to provide a hingedly connected two-piece adjustable antenna bracket for readily installing a plurality of antennas in which the bracket is sized to fit around an electric transmission tower adjacent the top thereof while reducing the time that the electric power must be turned off and/or rerouted, eliminating human error in separately installing a plurality of fixed brackets and antennas, and reducing the time, labor, and materials (e.g., bolts, shims, etc.) required for positioning the plurality of antennas relative to each other, positioning the plurality of antennas relative to other antenna sites, and aligning the plurality of antennas plumb to the earth.

It is also an object of another embodiment of the present invention to provide an adjustable antenna bracket for installing a plurality of antennas in which the bracket is readily attachable to a building roof top while eliminating human error in separately installing a plurality of fixed brackets and antennas on different sides of the building, and reducing the time, labor, and materials (e.g., bolts, shims, etc.) required for positioning the plurality of antennas relative to each other, positioning the plurality of antennas relative to other antenna sites, and aligning the plurality of antennas plumb to the earth.

It is another object of the present invention to provide an adjustable antenna bracket having attachments for readily positioning three antennas 120 degrees apart from each other.

It is another object of the present invention to provide an adjustable antenna bracket which is easily rotated for orienting a plurality of antennas relative to a predetermined direction, e.g., true north or a certain number of degrees from north.

It is another object of the present invention to provide an adjustable antenna bracket wherein aligning one antenna plumb with the earth, e.g., perpendicular or vertically true to the ground, automatically and simultaneously aligns the other antennas.

It is another object of the present invention to provide an adjustable antenna bracket which is readily and inexpensively manufactured for widespread installation and use for the many antenna sites required for wireless communication systems.

Certain of the foregoing and related objects are readily obtained in an adjustable antenna bracket for supporting a plurality of antennas from a pole in which the adjustable antenna bracket comprises means for straddling a pole, means attached to the straddling means for supporting a plurality of antennas, and means for adjustably mounting at least one of the straddling means and the supporting means on, and to the pole, respectively.

The straddling means preferably comprises a plurality of horizontally disposed, spaced-apart, rings. Advantageously, each of the rings comprises a first half and a second half, each of the halves having a first end and a second end, and the first ends being hingedly connectable and the second ends being releasably connectable.

The supporting means preferably comprises three vertically disposed parallel members, e.g., pipes, preferably angularly oriented 120 degrees from each other.

The adjustable mounting means preferably comprises the straddling means comprising a plurality of threaded bores, and a plurality of threaded bolts, each of which is receivable through and threadably adjustable in one of the threaded bores. Desirably, the adjustable antenna bracket comprises a plurality of foot plates, each of which is attached to a threaded end of each of the plurality of threaded bolts, and a plurality of swivel joints, each of which is disposed between one of the threaded ends of the threaded bolts and the foot plates.

Advantageously, the uppermost ring comprises a top plate and a centrally disposed hole extending through the top plate.

Certain of the foregoing and related objects are also readily obtained in an adjustable antenna bracket kit for supporting a plurality of antennas from a pole in which the kit comprising means for straddling a pole, means for supporting a plurality of antennas, and means for adjustably mounting the straddling means and the supporting means on, and to the pole, respectively.

Certain of the foregoing and related objects are also readily obtained in a method of adjustably mounting a plurality of antennas to a pole in which the method comprises the steps of providing an adjustable antenna bracket comprising means for straddling a pole, means attached to the straddling means for supporting a plurality of antennas, and means for adjustably mounting the straddling means and the supporting means on, and to the pole, respectively.

The method steps further include attaching a plurality of antennas to the supporting means, lifting the adjustable antenna bracket adjacent to the top of a pole, placing the adjustable antenna bracket around the vertical outer surface of the pole, rotating the adjustable antenna bracket to a predetermined orientation, and adjusting the adjustable mounting means so that the supporting means is aligned perpendicular to the earth.

Certain of the foregoing and related objects are further readily obtained in an adjustable antenna bracket for supporting a plurality of antennas from a roof top in which the adjustable antenna bracket comprises means for supporting a plurality of antennas in parallel and angularly spaced-apart relationship, and means for adjustably mounting the supporting means on and to a roof top, respectively.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustrations only, and not as a definition of the invention.

In the drawings, wherein similar reference numerals denote similar elements throughout the several views.

DETAILED DESCRIPTION OF THE PREFERRED EMBODIMENTS

Figure 1:
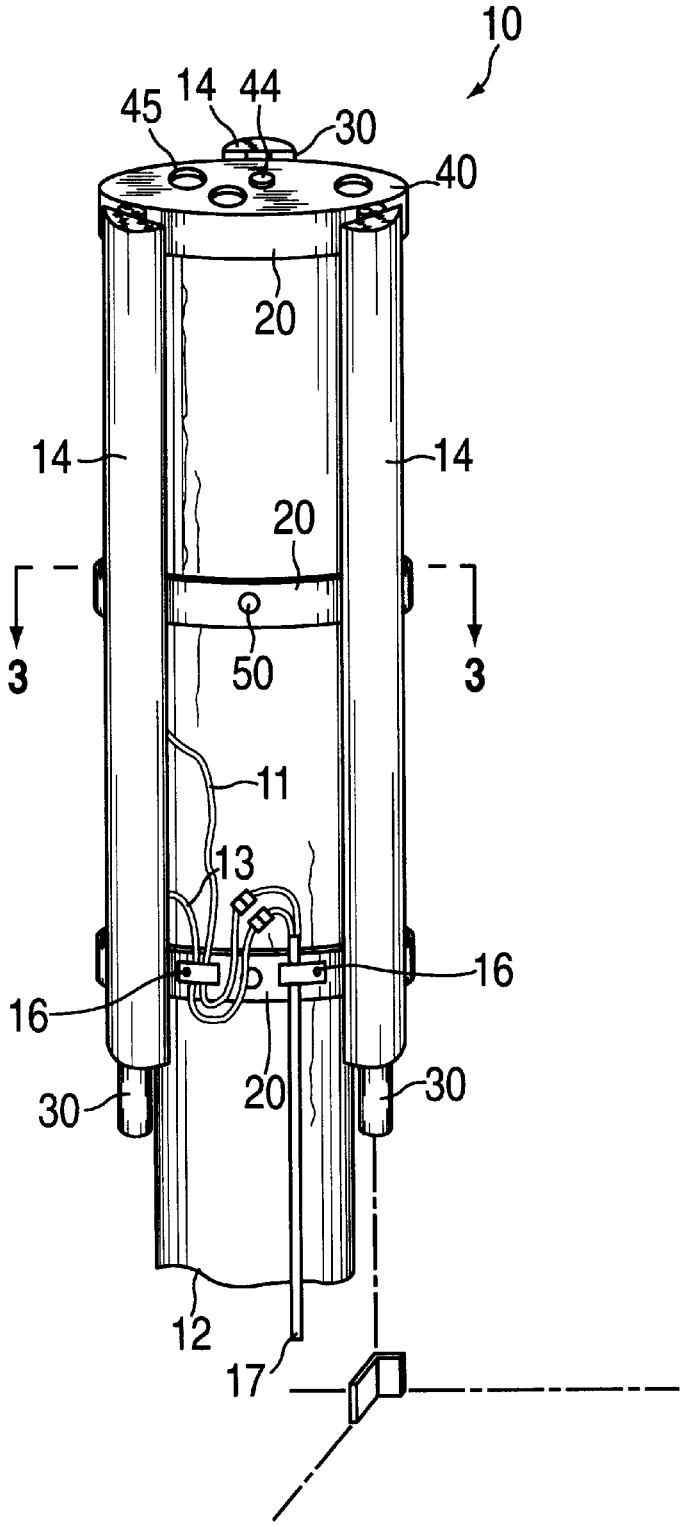
FIG. 1 is a perspective view of one embodiment of an adjustable antenna bracket according to the present invention for attaching three antennas to the top of a wooden utility pole.

Turning now to the drawings, therein illustrated in FIG. 1 is one embodiment of a novel adjustable antenna bracket 10 according to the present invention in which the bracket is attachable to the top of a wooden utility pole 12 for supporting three antennas 14. In particular, adjustable antenna bracket 10 is multi functional in that the bracket allows ready and facile installation of three antennas relative to each other, relative to other antenna sites, and relative to the earth.

In this illustrated embodiment, adjustable antenna bracket 10 comprises three horizontally disposed rings 20, three vertically disposed pipes 30, a top plate 40, and six adjustable mounting or brace assemblies 50 (best seen in FIG. 4), which together define a framework attachable to the top of a utility pole and to which are attachable antennas 14.

Figure 3:
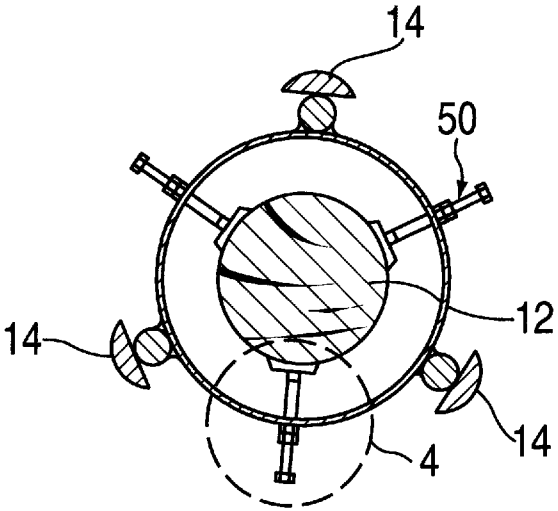
FIG. 3 is a cross-sectional view taken along line 3—3 in FIG. 1.
Figure 2:
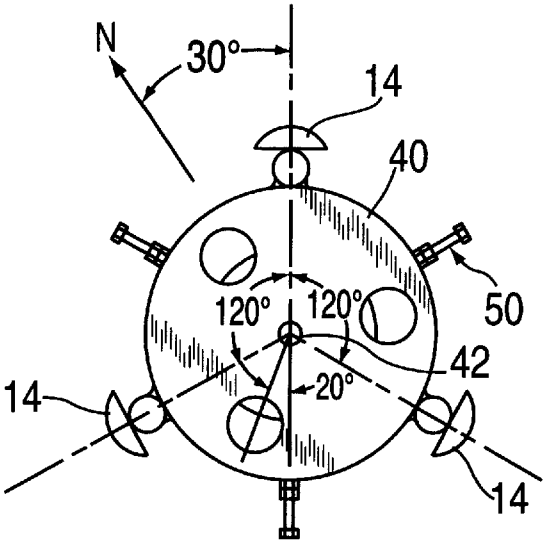
FIG. 2 is a top view of the adjustable antenna bracket shown in FIG. 1.

As shown in FIGS. 1–3, ring 20 comprises a circular band having a diameter greater than the diameter of utility pole 12 so as to straddle or surround a portion of the outer vertical surface of utility pole 12 and to provide a gap between the outer vertical surface of utility pole 12 and the inner surface of rings 20. Rings 20 are formed desirably having the same diameter and are vertically spaced-apart from one another. As used herein, the term "ring" is meant to include a circular band, as well as a band formed from a number of flat pieces, curved pieces, or combinations thereof, which are suitably connected to form a band.

Each vertically disposed pipe 30 attaches to each ring 20. In particular, pipes 30 are attached to rings 20 so that pipes 30 are parallel to each other and angularly spaced-apart from each other. Preferably, pipes 30 are spaced-apart 120 degrees from each other so that when an antenna is attached to each pipe 30, each antenna can be readily angularly spaced-apart 120 degrees from each other thereby resulting in an omni-directional antenna site. Desirably, pipes 30 are suitably welded or attached by nuts and bolts to rings 20.

Top plate 40 attaches to the uppermost ring 20 and provides a support for resting adjustable antenna bracket 10 upon the top surface of utility pole 12 thereby preventing adjustable antenna bracket 10 from sliding downwardly to the ground during installation. Advantageously, top plate 40 is also provided with a centrally located hole 42 (FIG. 2) through which a pivot pin or lag bolt 44 (FIG. 1) can be inserted allowing adjustable antenna bracket 10 to be readily rotated about the top of utility pole 12 so that the bracket can be oriented relative to other antenna sites. In addition, top plate 40 enhances the strength and integrity of the adjustable antenna bracket.

Figure 4:
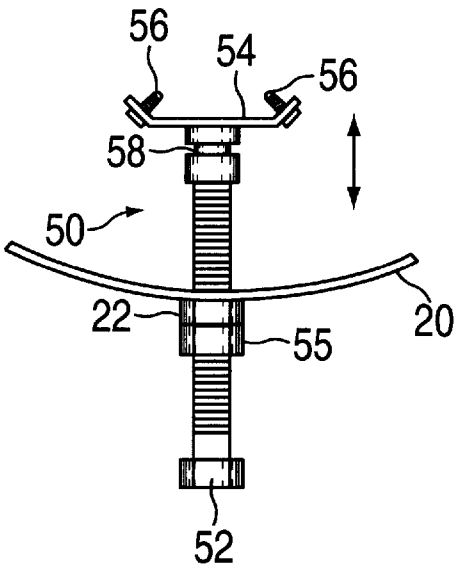
FIG. 4 is an enlarged view of detail 4 shown in FIG. 3.

As shown in FIGS. 1, 3, and 4, three adjustable mounting or brace assemblies 50 are adjustably attached to each of the two lowermost rings 20 for adjustably mounting adjustable antenna bracket 10 to the top of utility pole 12. Brace assemblies 50 are adjustable, as described in installation section below, so as to allow adjustable antenna bracket 10 to be readily rotated and orientated, e.g., relative to true north, and aligned plumb with the earth. In this illustrated embodiment, brace assemblies 50 are desirably angularly spaced-apart 120 degrees from each other and desirably offset 60 degrees from pipes 30. In addition, once adjustable antenna bracket 10 is rotated into a desired oriented position, brace assemblies 50 are adjustable radially inwardly and outwardly relative to ring 20, as illustrated by the double headed arrow B shown in FIG. 4, for aligning adjustable antenna bracket 10 relative to the earth, i.e., plumb or perpendicular to the earth. Also, once adjustable antenna bracket 10 is properly positioned, brace assemblies 50 can be fastened to pole 12 to rigidly secure adjustable antenna bracket 10 in place.

As best seen in FIG. 4, each of brace assemblies 50 comprises a threaded bolt 52 radially extending through a bore in ring 20 and threadably adjustably received in a nut 22 attached, e.g., welded, to the outer surface of ring 20. A foot plate 54 is attached to the threaded end of bolt 52. Foot plate 54 provides an interface between adjustable antenna bracket 10 and utility pole 12 (not shown in FIG. 4). Desirably, foot plate 54 is flexible or curved to correspond to the outer curved surface of utility pole 12.

Advantageously, foot plate 54 is provided with a plurality of holes (not shown) so that when foot plate 54 is pressed against utility pole 12, foot plate 54 can then be secured with lag bolts 56 to secure adjustable antenna bracket 10 in place. Desirably, brace assembly 50 comprises a swivel joint 58 between bolt 52 and foot plate 54 to allow foot plate 54 to rest squarely on the outer surface of utility pole 12. A lock nut 55 when tightened to nut 22 prevents bolt 52 from vibrating loose due to wind or other vibrations.

Preferably, adjustable antenna bracket 10 is fabricated from a metal such as stainless steel or aluminum. While top plate 40 may be made of metal, it may also be made of plastic, fiberglass, or wood so long as it is capable of supporting the weight of the adjustable antenna bracket and antennas when supported on top of a utility pole.

While the illustrated antenna bracket is shown as comprising circular-shaped rings and a round top plate, from the present description it will be appreciated to those skilled in the art that the bands and the top plate can be have other configurations, e.g., a square-shaped ring and top, a triangle-shaped ring and top, a hexagon-shaped ring and top, an octagon-shaped ring and top. It will also be appreciated that the vertically disposed supports may be angle irons or solid rods.

From the present description, it will also be appreciated to those skilled in the art that the top plate need not be included. In particular, an adjustable antenna bracket without a top plate would be desirable for attaching the adjustable antenna bracket at a position below the top of a utility pole.

Figure 6:
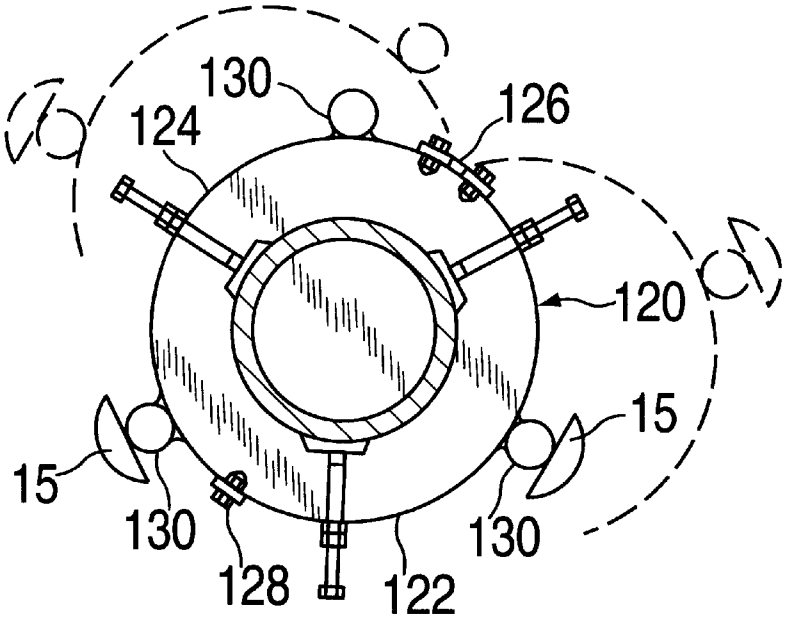
FIG. 6 is a cross-sectional view taken along line 6—6 in FIG. 5 in which the bracket halves are shown in a closed position in solid lines and the bracket halves are shown in an open position in dashed lines.
Figure 5:
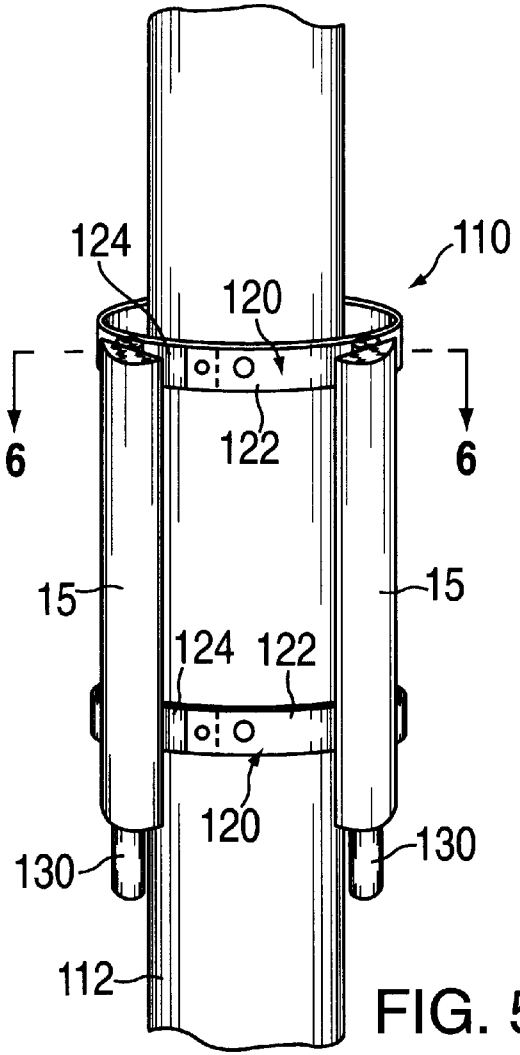
FIG. 5 is a perspective view of an alternative embodiment of an adjustable antenna bracket according to the present invention for attaching two antennas to an electric transmission tower.

FIGS. 5 and 6 illustrate another embodiment according to the present invention for an adjustable antenna bracket 110 which is readily attachable to an electric transmission tower 112. Adjustable antenna bracket 110 comprises two horizontally disposed rings 120, three vertically disposed pipes 130, and six brace assemblies 50, which together define a framework attachable to an electric transmission tower and to which are readily attachable two antennas 15. Depending on the area to be covered by the antennas, it is appreciated that a third antenna can be attached to adjustable antenna bracket 110.

In this illustrated embodiment, rings 120 comprise two pieces or halves 122 and 124 which are hingedly attached via a hinge 126 at one end of the halves and releasably connected at their other end with a bolt 128. The configuration of rings 120 provide a clam-shell like adjustable antenna bracket having an open position shown in dashed lines in FIG. 6 and a closed position shown in solid lines in FIG. 6.

Figure 7:
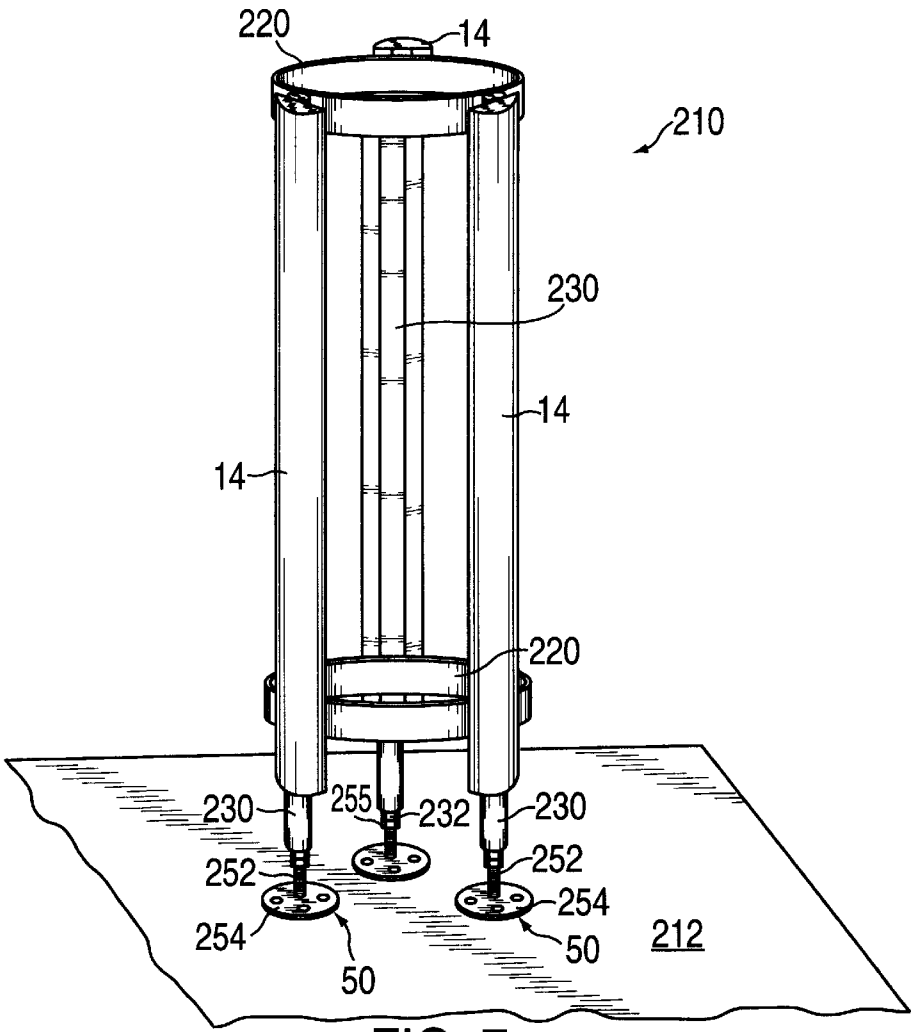
FIG. 7 is a perspective view of still another alternative embodiment of an adjustable antenna bracket according to the present invention for attaching three antennas to a roof top.

FIG. 7 illustrates still another embodiment according to the present invention for an adjustable antenna bracket 210 which is readily attachable to a roof top 212. In this illustrated embodiment, antenna bracket 210 comprises two horizontally disposed rings 220, three vertically disposed pipes 230, and leveling assemblies 250, which together define a framework attachable to roof top 212 and to which are attachable antennas 14.

In this illustrated embodiment, each of leveling assemblies 250 comprises a threaded bolt 252 which attaches to a circular mounting plate 254. A threaded nut 232 is attached, e.g., welded, to the lower end of pipe 230 for threadably receiving bolt 252. By rotating bolt 252 in nut 232, adjustable antenna bracket 210 can be adjustably oriented perpendicular with the earth, i.e., plumb.

Figure 8:
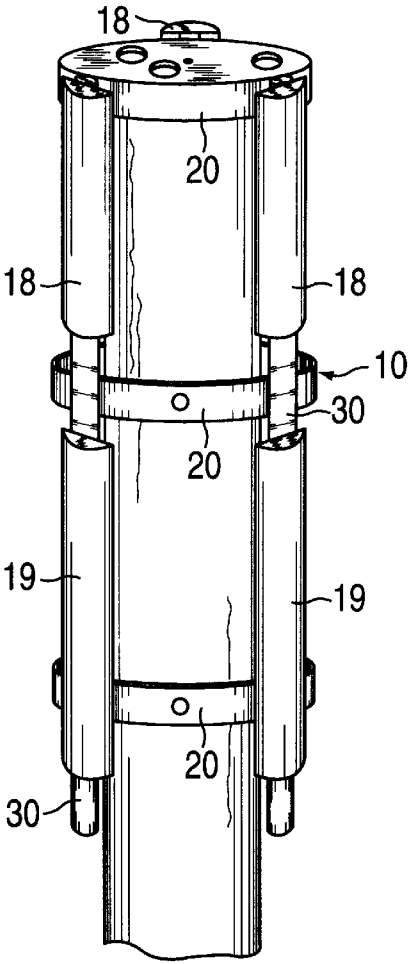
FIG. 8 is a perspective view of the antenna bracket shown in FIG. 1 to which is attached two sets of three antennas.

FIG. 8 illustrates an antenna site comprising adjustable antenna bracket 10, a first set of three antennas 18 and a second set of three antennas 19 (only two of which are shown in FIG. 8), which as will be described below, all six antennas are simultaneously adjusted by adjusting one of pipes 30.

Installation

Installation is made first with reference to the illustrated adjustable antenna bracket 10 shown in FIGS. 1–4. Initially, antennas 14 are attached to pipes 30 via conventional clamps and brackets (not shown). One antenna is identified and marked which will point, e.g., 30 degrees clockwise from true north, depending on the wireless system. Each antenna mounted on one of pipes 30 is then rotated so that equal distances are provided between the rear corners of the top of the antenna and the uppermost ring 20 of adjustable antenna bracket 10. This angularly positions the three antennas 120 degrees from each other.

Typically, each antenna 14 is connected to two jumpers 11 and 13. As shown in FIG. 1, jumper 11 is disposed on one side of an antenna and jumper 13 is disposed on the other side of the antenna (only two of the six jumpers being shown in FIG. 1). Jumpers 11 and 13 are fixedly attached to adjustable antenna bracket 10, and desirably to ring 20, by clamp 16. Attachment of jumpers 11 and 13 to adjustable antenna bracket 10 reduces the likelihood of the connection between the jumpers and antennas 14 from separating.

The six adjustable brace assemblies 50 are then drawn back, e.g., unscrewed, to their furthest points away from the center of adjustable antenna bracket 10. The complete assembly, i.e., adjustable antenna bracket 10, antennas 14, and jumpers 11 and 13, is then lifted over the top end of utility pole 12 and lowered downwardly so that top plate 40 of adjustable antenna bracket 10 sits on the top of utility pole 12. Advantageously, either top plate 40 or uppermost ring 20 can be provided with one or more lifting hooks or eyes (not shown).

Centrally located hole 42 of top plate 40 is approximately positioned over the center of the top of utility pole 12. Lag bolt 44 is partially screwed into the top of utility pole 12 creating a pivot point for rotating antenna bracket 10. Desirably, lag bolt 44 is not screwed all the way in, but protrudes out of hole 42 approximately one-inch or more thereby allowing adjustable antenna bracket 10 to be easily rotated. Also, as described below, it may be necessary to remove and reposition this pivot point later in the installation.

Adjustable antenna bracket 10 is then rotated in the directions of double-headed curved arrow A (FIG. 2), to align the marked antenna in a predetermined direction, e.g., 30 degrees clockwise from true north, depending on the wireless system. Brace assemblies 50 which are attached to lowermost ring 20 are adjusted so that feet 54 lightly contact the outer surface of utility pole 12. Adjustable antenna bracket 10 is aligned by placing a vertical level against the front and side surfaces of one of pipes 30, e.g., 90 degrees apart, while loosening one brace assembly 50 and tightening the other brace assemblies 50 and repeating this process until the adjustable antenna bracket is plumb and perpendicular with the earth. Aligning one of pipes 30 automatically and simultaneously aligns the other two pipes.

If the antenna bracket cannot be aligned plumb, e.g., because of the extreme curvature of the wooden pole, the top pivot is repositioned to one side of the pole and the process is repeated until the bracket is properly aligned. Once the marked antenna is orientated, e.g., 30 degrees clockwise from the north depending on the wireless system, and aligned plumb with the earth, lag bolts 56 are installed through holes located in each foot plate 54 of the lowermost brace assemblies 50. Lock nuts 55 on bolts 52 are tightened to lock the bracket in place.

Next, the brace assemblies 50 attached to middle ring 20 are adjusted to contact utility pole 12 and foot plate 54 is attached to utility pole 12 using lag bolts 56.

With reference again to FIG. 1, six transmission lines 17 (only two of which are shown) for carrying the RF power to the antennas are then attached to the utility pole. Transmission lines 17, e.g., HELIAX cables, are fixedly attached to the utility pole by conventional clamps. Each jumper is then connected to a separate transmission line. From the present description, it will be appreciated to those skilled in the art that depending on the type of antennas being supported by the adjustable antenna bracket, the number of jumpers, and number of transmission lines may vary.

Desirably, a ground connection (not shown) is made to the lowermost ring 20. Also desirably, a grounded lightening rod, dissipator, or spline ball (not shown) may be affixed on top of the antenna bracket or installed onto the wooden pole through one of holes 45 in top plate 40 to minimize lightening strikes.

From the present description, it will also be appreciated to those skilled in the art that installation can include the steps of attaching the antennas to the adjustable antenna, temporarily attaching the transmission lines to the adjustable antenna bracket, e.g., using a hook-like connector which attaches at one end to the transmission lines and at the other end releasably hooks onto the lower most ring of the adjustable antenna bracket. Thus, the adjustable antenna bracket, antennas and transmission lines can be lifted into position on the pole at the same time. The transmission lines can then be secured to the pole and the hook-like connector removed.

With reference again to FIGS. 5 and 6, installation of antenna bracket 110 is made by lifting antenna bracket 110 adjacent to the position where it is to be mounted to electric transmission tower 112. Antenna bracket 110 is then opened and ring halves 122 and 124 are placed around tower 112 and then ring halves 122 and 124 are closed and fastened by securing bolt 128. The brace assemblies are adjusted as explained above. From the present description, it will be appreciated to those skilled in the art that the time that the power through the electric transmission lines of the tower must be turned off and/or rerouted is significantly reduced for installation of antenna bracket 110 compared to installing three separate antenna brackets to the tower.

With reference again to FIG. 7, installation of antenna bracket 210 is made by lifting antenna bracket 210 onto roof top 212, and adjusting leveling assemblies 250 to bring one of pipes 230 in true vertical alignment, i.e., plumb or perpendicular with the earth. Lock nut 255 is then tightened to lock antenna bracket 210 in place.

From the present description it will be appreciated to those skilled in the art that the present invention for providing a bracket attachable to a structure for purposes of mounting antennas may also be suitable for mounting, e.g., cameras, lights, or weather monitoring equipment. It will also be appreciated to those skilled in the art that an adjustable antenna bracket may comprise two rings, two or four pipes, and two (angularly spaced 180 degrees apart) or four (angularly spaced 90 degrees apart) brace assemblies which are adjustably attached to each ring.

Furthermore, it will be appreciated that the straddling means or rings and the supporting means or pipes form a resulting framework or cage-like structure which together serves both functions, i.e., straddling a pole and supporting a plurality of antennas. It is also appreciated that a cage-like structure can be provided with mounts or holes for readily attaching a plurality of antennas in parallel and angularly spaced-apart relationship.

Thus, while several embodiments of the present invention have been illustrated and described, it will be appreciated to those skilled in the art that many changes and modifications may be made thereunto without departing from the spirit and scope of the invention.

What is claimed is:

1. An adjustable antenna bracket for supporting a plurality of antennas from a vertically-disposed wooden utility pole having a vertical axis, said antenna bracket comprising:

means for straddling a pole, said means including a plurality of horizontally disposed rings spaced vertically apart from one another, said rings each having an axis generally coaxial to said axis of said pole;

means for supporting a plurality of antennas, said supporting means attached to said straddling means, wherein said supporting means comprises a plurality of vertically disposed support members affixed to said rings to define a framework, said vertically disposed members being generally parallel to said axis of said pole; and means for adjustably mounting and orienting said straddling means and said supporting means on the pole.

2. The adjustable antenna bracket according to claim 1, wherein said straddling means comprises three rings.

3. The adjustable antenna bracket according to claim 1, wherein each of said rings comprises a first half and a second half, each of said halves having a first end and a second end, and said first ends being hingedly connectable and said second ends being releasably connectable.

4. The adjustable antenna bracket according to claim 1, wherein said plurality of vertically disposed members are parallel.

5. The adjustable antenna bracket according to claim 4, wherein said vertically disposed members are angularly oriented 120 degrees from each other.

6. The adjustable antenna bracket according to claim 1, wherein said vertically disposed members comprise a plurality of pipes.

7. The adjustable antenna bracket according to claim 6, wherein said supporting means comprising three pipes.

8. The adjustable antenna bracket according to claim 1, wherein said mounting and orienting means comprises said straddling means comprising a plurality of threaded bores, and a plurality of threaded bolts each of which is receivable through and threadably adjustable in one of said bores.

9. The adjustable antenna bracket according to claim 8, wherein said mounting and orienting means further comprises a plurality of foot plates, each of which is attached to a threaded end of each of said plurality of threaded bolts.

10. The adjustable antenna bracket according to claim 9, wherein said mounting and orienting means further comprises a plurality of swivel joints, each of which is disposed between one of said threaded ends of said threaded bolts and said foot plates.

11. The adjustable antenna bracket according to claim 1, wherein said straddling means comprises a top plate.

12. The adjustable antenna bracket according to claim 11, where in said top plate comprises a centrally disposed hole extending through said top plate.

13. The adjustable antenna bracket according to claim 1, further including a plurality of antennas attached to said supporting means.

14. An adjustable antenna bracket kit for supporting a plurality of antennas from a vertically-disposed wooden utility pole having a vertical axis, said kit comprising:

means for straddling a pole, said means including a plurality of horizontally disposed rings spaced vertically apart from one another, said rings each having an axis generally coaxial to said axis of said pole;

means for supporting a plurality of antennas, wherein said supporting means comprises a plurality of vertically disposed support members affixed to said rings to define a framework, said vertically disposed members being generally parallel to said axis of said pole; and means for mounting and orienting said straddling means and said supporting means on the pole.

15. The adjustable antenna bracket kit according to claim 14, wherein said supporting means comprises a plurality of pipes.

16. The adjustable antenna bracket kit according to claim 15, wherein said mounting and orienting means comprises said straddling means comprising a plurality of threaded bores, and a plurality of threaded bolts each of which is receivable through and threadably adjustable in one of said threaded bores.

17. A method of adjustably mounting a plurality of antennas to a wooden utility pole, said method comprising the steps of;

providing an adjustable antenna bracket comprising:

means for straddling a pole, said means including a top plate having a hole;

means for supporting a plurality of antennas, said supporting means attached to said straddling means; and means for adjustably mounting and orienting said straddling means and said supporting means on the pole;

attaching a plurality of antennas to said supporting means;

lifting said adjustable antenna bracket adjacent the top of a pole;

placing said adjustable antenna bracket around the vertical outer surface of said pole;

placing a pivot pin through and into said hole of said top plate and into the top of said pole;

rotating said antenna bracket about said pivot pin to a predetermined orientation; and adjusting said adjustable mounting means so that said supporting means is aligned perpendicular to the earth.

18. The adjustable antenna bracket according to claim 15, wherein said supporting means comprises a plurality of horizontally disposed, spaced-apart, rings, and a plurality of vertically disposed members.

19. The adjustable antenna bracket according to claim 18, wherein said adjustable mounting means comprises said vertically disposed members comprising a plurality of threaded bores, and a plurality of threaded bolts each of which is threadably receivable through and threadably adjustable in said threaded bores.

20. The adjustable antenna bracket according to claim 19, wherein said adjustable mounting means further comprises a plurality of foot plates, each of which is attached to an end of each of said plurality of threaded bolts.

21. An adjustable antenna bracket for supporting a plurality of antennas from a pole, said antenna bracket comprising:

means for straddling a pole;

means for supporting a plurality of antennas, said supporting means attached to said straddling means; and means for adjustably mounting said straddling means and said supporting means on, and to the pole, respectively, said means for adjustably mounting comprising said straddling means including a plurality of threaded bores, and a plurality of threaded bolts each of which is receivable through and threadably adjustable in one of said bores, said means for adjustably mounting further comprises a plurality of foot plates, each of which is attached to a threaded end of each of said plurality of threaded bolts.

22. The adjustable antenna bracket according to claim 21, wherein said means for adjustably mounting and orienting means further comprises a plurality of swivel joints, each of which is disposed between one of said threaded ends of said threaded bolts and said foot plates.

23. An adjustable antenna bracket for supporting a plurality of antennas from a wooden utility pole, said antenna bracket comprising:

means for straddling a pole, said means including a plurality of said horizontally disposed, spaced-apart, rings spaced vertically apart from one another and wherein each of said rings comprises a first half and a second half, each of said halves having a first end and a second end, and said first ends being hingedly connectable and said second ends being releasably connectable.

24. An adjustable antenna bracket for supporting a plurality of antennas from a wooden utility pole, said antenna bracket comprising:

means for straddling a pole, said means including at least one horizontally disposed ring;

means for supporting a plurality of antennas, said supporting means attached to said straddling means, wherein said supporting means comprises a plurality of vertically disposed members, and wherein said vertically disposed members comprise a plurality of pipes; and means for adjustably mounting and orienting said straddling means and said supporting means on the pole.

25. An adjustable antenna bracket for supporting a plurality of antennas from a wooden utility pole, said antenna bracket comprising:

means for straddling a pole, said means including at least one horizontally disposed ring;

means for supporting a plurality of antennas, said supporting means attached to said straddling means, wherein said supporting means comprises a plurality of vertically disposed members; and means for adjustably mounting and orienting said straddling means and said supporting means on the pole comprising said straddling means comprising a plurality of threaded bores, and a plurality of threaded bolts each of which is receivable through and threadably adjustable in one of said bores and a plurality of foot plates, each of which is attached to a threaded end of each of said plurality of threaded bolts.

* * * * *